US005682609A

United States Patent [19]

Ayo

[11] Patent Number: 5,682,609

[45] Date of Patent: Nov. 4, 1997

[54] ARM ENGAGING BIB

[76] Inventor: Donna L. Ayo, 2653 66th Ave., Oakland, Calif. 94605

[21] Appl. No.: 547,703

[22] Filed: Oct. 19, 1995

Related U.S. Application Data

[63] Continuation-in-part of Ser. No. 22,418, May 4, 1994, abandoned.

[51] Int. Cl.[6] ..... A41B 13/00

[52] U.S. Cl. ..... 2/49.2; 2/52; 2/49.1

[58] Field of Search ..... 2/49.1, 49.2, 50, 2/51, 52, 88, 92, 48

[56] References Cited

U.S. PATENT DOCUMENTS

| | | | |
|---|---|---|---|
| D. 232,276 | 8/1974 | Andersson | 2/49.1 X |
| D. 238,117 | 12/1975 | Andersson | D2/229 |
| D. 238,686 | 2/1976 | Martin | D27/14 |
| 2,451,038 | 10/1948 | Mink | 2/49.1 X |
| 2,526,505 | 10/1950 | Richmond | 2/50 |
| 2,898,599 | 8/1959 | Seckendorf | 2/88 |
| 3,299,440 | 1/1967 | Grable | 2/49.1 X |
| 3,665,518 | 5/1972 | Leadford | 2/88 |
| 3,945,048 | 3/1976 | Shearer | 2/49 R |
| 4,233,688 | 11/1980 | Hjerl | 5/49 R |
| 4,793,004 | 12/1988 | Long et al. | 2/49 R |
| 5,490,289 | 2/1996 | Lehrer | 2/49.1 X |

FOREIGN PATENT DOCUMENTS

| | | | |
|---|---|---|---|
| 2110066 | 6/1983 | United Kingdom | 2/49.2 |

*Primary Examiner*—C. D. Crowder
*Assistant Examiner*—Shirra L. Jenkins
*Attorney, Agent, or Firm*—Harris Zimmerman

[57] ABSTRACT

A bib for covering the chest region of a wearer's body has a sheet of flexible material which is proportioned to extend between the wearer's shoulders and which has openings through which the wearer's arms may extend. Tie strings connect with the side edges of the sheet at locations which are spaced downward from the upper edge and thus need not encircle the wearer's neck. A slot extends downward from the upper edge of the sheet at a location midway between the side edges of the sheet to enable the upper edge to lie flat against the wearer's throat. In one form of the bib an open pocket extends along the lower edge of the bib to intercept substances. Optionally, the bib may be formed of transparent material or may be a laminate having a waterproof inner layer and an absorbent outer layer that may be used in the manner of a napkin.

10 Claims, 3 Drawing Sheets

ARM ENGAGING BIB

CROSS REFERENCE TO RELATED APPLICATION

This application is a continuation-in-part of my prior design application Ser. No. 29/022,418 filed May 4, 1994, now abandoned.

TECHNICAL FIELD

This invention relates to bibs of the type used to cover a wearer's chest during eating or other activities that might cause dampening and staining of underlying clothing.

BACKGROUND OF THE INVENTION

The traditional bib as used during the feeding of infants for example consists of a sheet of flexible material having tie strings at the top which encircle the wearer's neck during in use, This arrangement for fastening the bib to the wearer and the configuration of the traditional bib as a whole are not ideally suited for the purpose of protecting the wearer from the adverse effects of dribbled liquids and dropped food.

The tie strings cannot be tautly tied around the wearer's neck without causing discomfort. Consequently, the upper edge of the bib material tends to droop and may not be effective to prevent passage of substances under the bib. The neck fastening also allows the bib to shift to one side or other of its intended location. The wearer's arms must necessarily reach around the side edges of the bib and arm movements can laterally compress the bib thereby reducing its effective area.

If liquids or food is released by the bib wearer in sizable quantities the material may travel down the entire length of the bib and be deposited on underlying clothing, furniture or flooring.

The conventional bib is conspicuous and obscures the underlying clothing of the wearer. While this does not interfere with its intended operation it can variously be a source of embarrassment to the wearer and create resistance to use of a bib.

A bib is preferably formed of waterproof material to prevent liquids from soaking through the bib. Waterproof materials are inherently non-absorbent and thus liquids and food particles may not adhere to the bib.

The present invention is directed to overcoming one or more of the problems discussed above.

SUMMARY OF THE INVENTION

In one aspect of the present invention, a bib for covering the front of at least an upper region of a wearer's chest has a sheet of flexible material shaped and proportioned to extend between the wearer's shoulders and to extend downward therefrom. The sheet of material has arm receiving openings proportioned and located to enable insertion of the wearer's arms through the sheet when it is emplaced against the wearer's chest.

In another aspect of the invention, the sheet has an upper edge situated above the arm receiving openings in position to contact and lie flat against the wearer's neck and has a vertical slit which intersects the upper edge at a central location along the edge.

In another aspect of the invention, tie strings extend from the side edges of the sheet of material. The tie strings connect to the side edges of the sheet at locations which are spaced downward from the upper edge of the sheet.

In another aspect, the invention provides a bib which includes a sheet of flexible material having a first perforated zone that extends downward from the upper edge of the sheet at a location which is substantially midway between the opposite side edges of the sheet. Second and and third perforated zones extend vertically at locations below the upper edge each being in proximity to a separate one of the opposite side edges of the sheet. Fourth and fifth perforated zones extend upward from the lower edge of the sheet of material in proximity to the opposite edges thereof and terminate at locations that are spaced downward from the upper edge of the sheet.

The invention provides a bib which fastens securely to the wearer without requiring encircling of the wearer's neck by tight tie strings. Tie strings are preferably provided but may be at a location below the neck. The wearer's arms are inserted though openings at shoulder covering regions of the bib. This prevents lateral shifting of the bib and maintains the bib in a laterally expanded state at which it covers a maximum expanse of the wearer's chest. The upper edge of the bib contacts the frontal region of the wearer's neck thereby inhibiting inflow of liquids underneath the bib. Preferably a transverse pocket extends along the lower edge of the bib to entrap liquids. In one form of the bib the sheet of material which covers the wearer's chest is transparent to allow the wearer's underlying clothing to be visible and to make the bib less conspicuous. In another form of the bib which may be disposable after use, the sheet of material is a laminate having an inner layer of waterproof plastic and an outer layer of absorbent material such as paper. This enables use of the bib to wipe liquids from the wearer's face and to clean up liquids or food particles that may have been deposited on the wearer's clothes or elsewhere.

The invention, together with further aspects and advantages thereof, may be further understood by reference to the following detailed description of the preferred embodiments and by reference to the accompanying drawings.

DETAILED DESCRIPTION OF THE PREFERRED EMBODIMENTS

Figure 1:
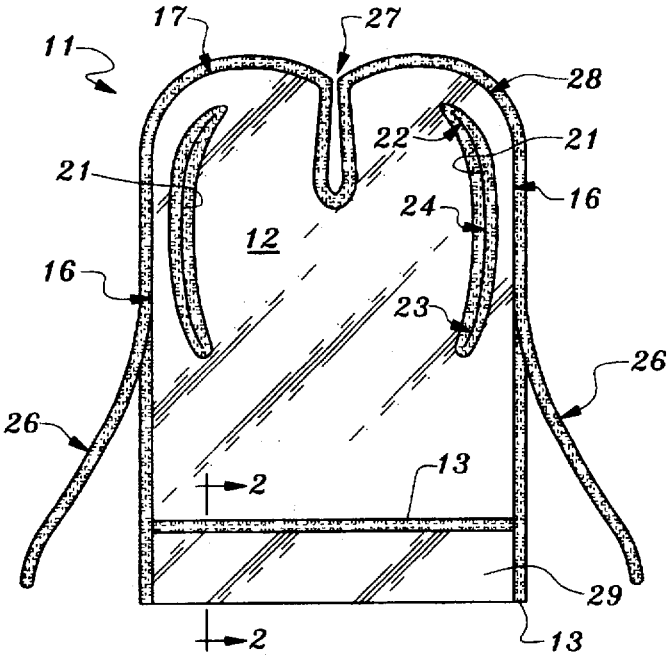
FIG. 1 is a front elevation view of a bib in accordance with a first embodiment of the invention.
Figure 2:
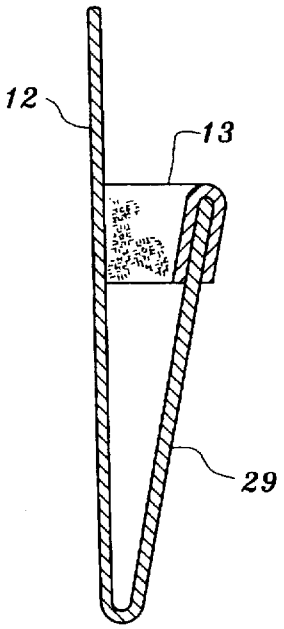
FIG. 2 is a section view taken along line 2—2 of FIG. 1.
Figure 3:
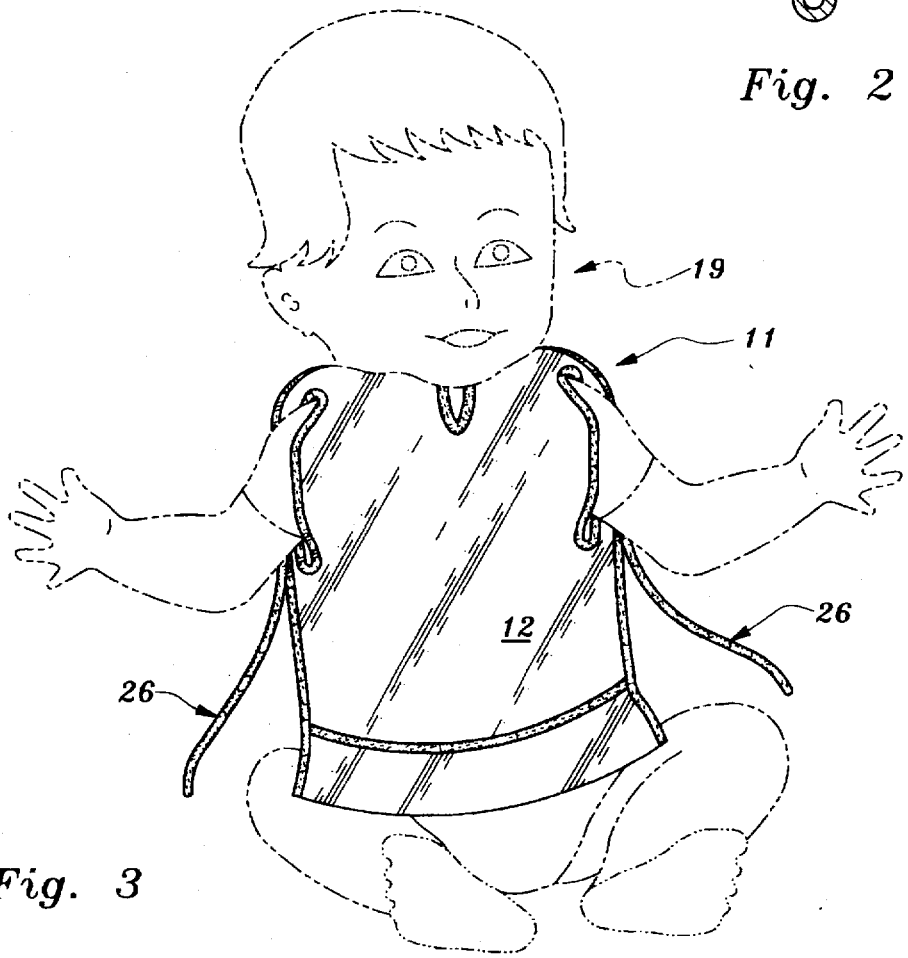
FIG. 3 is a frontal view of the bib of the preceding figures as it appears in use.

Referring initially to FIGS. 1, 2 and 3 of the drawings, a bib 11 in accordance with the first embodiment of the invention is formed primarily by a sheet of flexible material 12 which may variously be plastic, waterproof fabric, paper or the like. In this particular example the sheet of material 12 is a transparent plastic to allow the wearer's underlying clothing to be visible and to make the bib less conspicuous.

Although it is not essential in all instances, the bib 11 of this example has a decorative fabric edging 13 which is stitched to edges of the sheet of material 12 including along the opposite side edges 16 and along the upper edge 17.

The sheet of flexible material 12 is proportioned to extend between the wearer's shoulders, to extend upward from the level of the shoulders in order to contact the front of the wearer's neck and to extend downward preferably to the lap of a seated wearer. Bibs are commonly used to protect the clothing of small children during eating of a meal and the bib 11 of this example is sized for that purpose. It should be recognized that the bib can be made in larger sizes suitable for an older child or an adult who may have need of a bib.

Fastening of the bib 11 to the wearer 19 is provided for by a pair of arm receiving openings 21 which are proportioned and located to enable insertion of the wearer's arms through the openings. The openings 21 are preferably arcuate slits in the sheet of material 11 which have upper and lower ends 22 and 23 that are closer together than the intermediate regions 24 of the slits. This slit configuration allows the material 12 to overlay a portion of the upper arms of the wearer as well as the wearer's chest.

Figure 4:
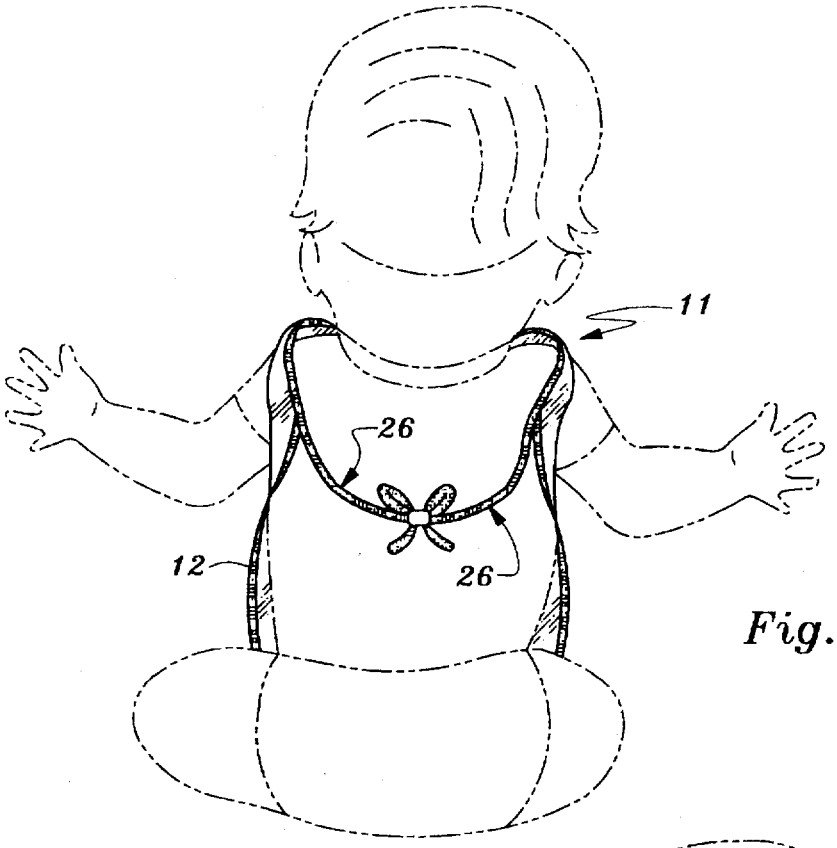
FIG. 4 is a rear view of the bib of the preceding figures as it appears during use.

Fastening of the bib 11 to the wearer is further provided for by a pair of flexible tie strings 26 which extend outward from the side edges 16 of the sheet of material 12. The tie strings 26 are connected to edges 16 at locations which are spaced downward from the upper edge 17 of the sheet of material 12 in order to locate the tie strings below the wearer's neck. Referring to FIG. 4, the tie strings 26 are tied together behind the wearer's back to complete the fastening of the bib 11 to the wearer.

Referring again to FIGS. 1, 2 and 3, the upper edge 17 of the sheet of material 12 has a configuration which enables the upper edge region of the material to lie flat against the front of the wearer's neck and thereby inhibit passage of liquids and food between the bib the neck. For this purpose the sheet of material 12 has a vertical notch or slit 27 which extends downward from its upper edge 17 at a location which is midway between the side edges 16 of the sheet. The upper edge 17 is preferably upwardly bowed at each side of the slit 27. Thus a lobe 28 of the sheet material 12 is present at each side of the slit 27 and the two lobes may fold in two different directions to accommodate to the curvature of the wearer's throat.

In the preferred form of the invention, a pocket 29 extends along the lower edge of the bib 11 to intercept and retain liquids which flow down the front surface of the bib. The pocket 29, which has an open top, extends along the full width of the bib 11. Additional portions of the previously described decorative edging 13 may be stitched to the top of pocket 29 and also along the edges of material 12 which bound slit 27 and the edges of the material which bound the arm receiving openings 21.

Referring to FIGS. 3 and 4 in particular, the presence of the wearer's arms in arm openings 21 acts to hold the upper edge 17 of the bib against the front of the wearer's throat without the use of tie strings at the neck itself. The wearer's arms also keep the bib 11 from being displaced to one side or the other of its intended position. A child cannot draw the upper portion of the bib outwardly to any significant extent. Thus the bib 11 is securely fastened to the wearer and is maintained in its intended position.

The above described embodiment of the invention is designed for repetitive use and will usually require repeated launderings. It also possible to manufacture the invention in the form of a low cost disposable bib which may be discarded after a single use.

Figure 5:
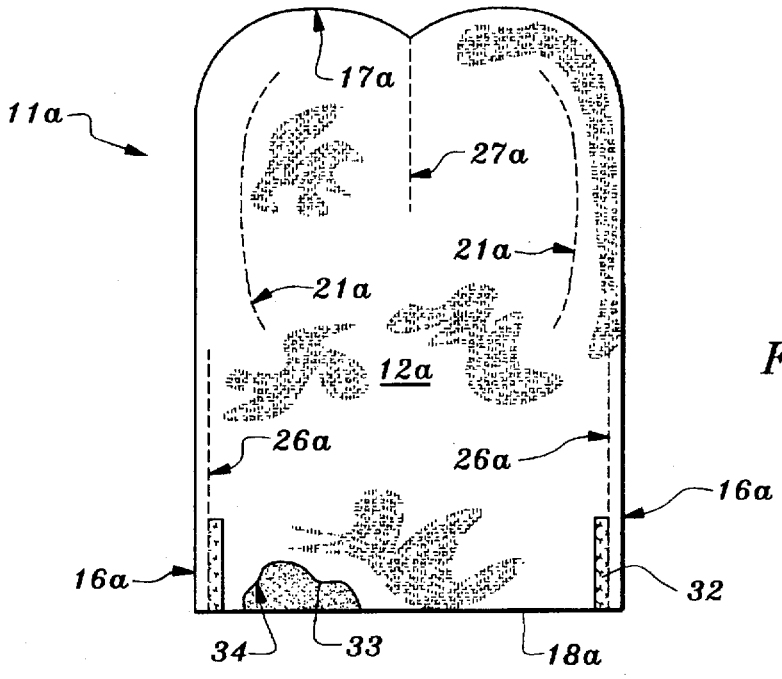
FIG. 5 is a front elevation view of a bib in accordance with a second embodiment of the invention.

Referring to FIG. 5, a disposable bib **11*a* may be formed in its entirety by a single continuous sheet of flexible material 12*a* although additional embellishments such as edging can be provided if desired. The sheet of material 12*a*** may have the same configuration as the sheet of material of the previously described embodiment except as is hereinafter described.

A first perforation zone **27*a* extends down from the center of the upper edge 17*a* of the material 11*a* to provide for a slit at that location for the previously described purpose. Second and third perforation zones 21*a* in the material 12*a* provide for arm receiving openings and may have configurations and locations similar to those of the arm receiving openings of the previously described embodiment of the invention. Tie strings for the FIG. 5 embodiment of the invention are provided for by fourth and fifth perforation zones 26*a* which extend upward from the bottom edge 18*a* of the sheet of material 11*a* at locations close to the opposite side edges 16*a* of the material and in parallel relationship with the side edges. The fourth and fifth perforation zones 26*a* terminate at a level which is spaced downward from the upper edge 17*a* of material 11*a*** sufficiently to locate the tie strings below the neck region of the wearer of the bib.

The perforation zones **27*a*, 21*a* and 26*a* may be formed by a series of small closely spaced apertures which extend wholly or partially through the sheet of material 11*a*, by a series of spaced apart cuts which extend wholly or partially through the material or by continuous cuts that do not extend wholly through the material. One or more of the perforation zones 27*a*, 21*a* and 26*a* may be a continuous preformed slit that extends all the way through the material 11*a* but it is easier to package, store and handle bibs 11*a* if the perforation zones are of one of the previously described types. Rupturing the material 11*a* along the perforation zones 27*a*, 21*a* and 26*a* just prior to use of the bib 11*a*** is a simple operation.

Figure 7:
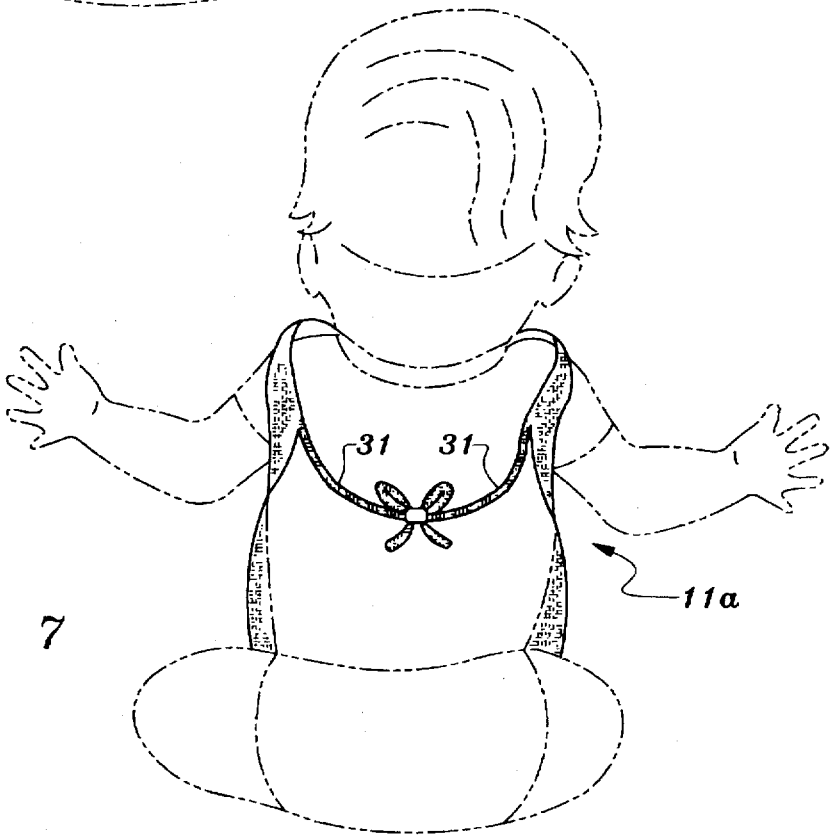
FIG. 7 is a rear view of the bib of FIGS. 5 and 6 as it appears during use.
Figure 6:
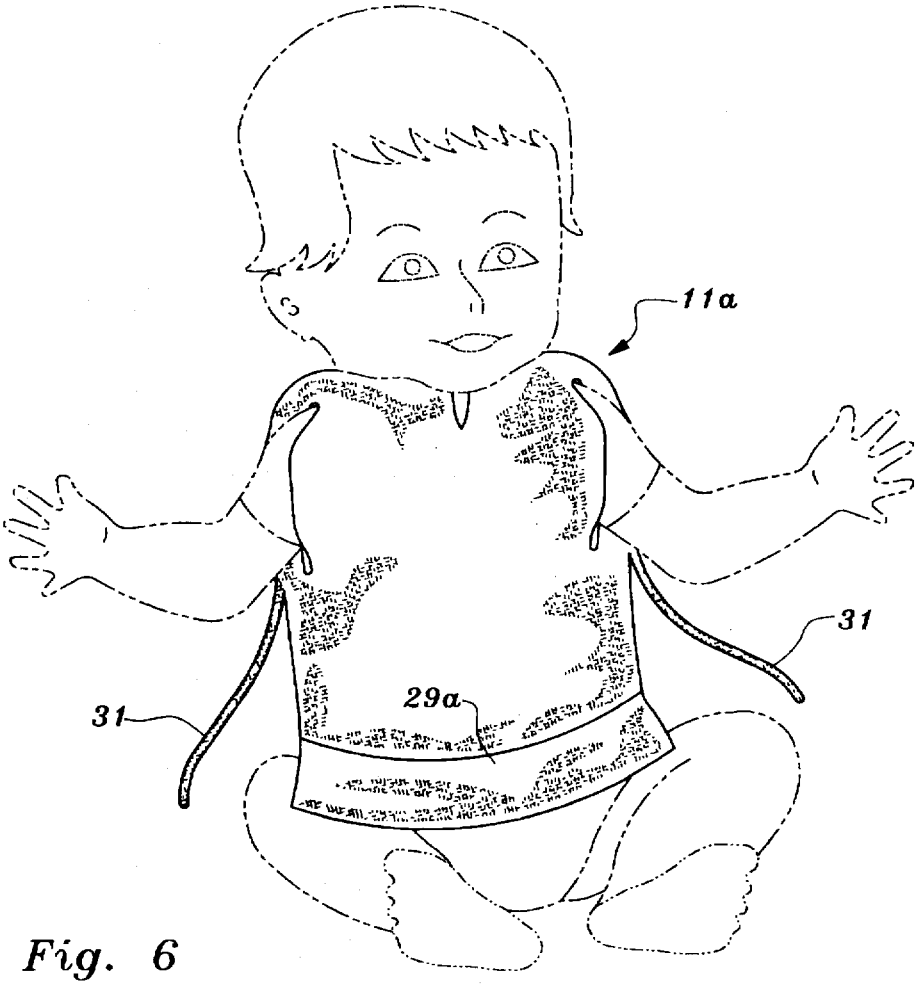
FIG. 6 is a frontal view of the bib of FIG. 5 as it appears during use.

Referring jointly to FIGS. 5, 6 and 7, rupturing of the material 11 along the perforation zones **27*a*, 21*a* and 26*a* allows the bib 11*a* to be fastened to a wearer in the same manner that the previously described embodiment is fastened and the bib provides the same advantages. The strips 31 which are created by rupturing the material along perforation zones 26*a* are utilized as tie strings. Ruptured zones 21*a* provide the arm receiving openings and ruptured zone 27*a* allows the upper edge 17*a*** to bend as needed in order to flatten against the wearer's throat.

If desired, a lower portion **29*a* of the sheet of material 12*a* can be folded to overlay an adjoining portion of the material to form a pocket for the previously described purpose. Zones 32 of adhesive may be provided on material 12*a* at each end of the pocket portion 29*a*** to hold the pocket portion in its folded condition.

The sheet of material **12*a* may be of any of the previously described types but is preferably a laminate having an inner layer 33 of waterproof plastic bonded to an outer layer 34 of absorbent material such as absorbent paper. Small amounts of liquids are absorbed by the paper or the like and small amounts of food are more likely to cling to an absorbent surface then to a waterproof surface. The absorbent outer surface makes it possible to use the bib 11*a*** to wipe liquids and food from the wearer's face in the manner that a napkin would be used or to use the bib for the purpose of wiping liquid or food from clothing or other surfaces where it may have been deposited.

While the invention has been described with reference to certain specific examples for purposes of example, many modifications and variations of the bib are possible and it is not intended to limit the invention except as defined in the following claims.

I claim:

1. In a bib for covering the front of at least an upper region of a wearer's chest which bib has a sheet of flexible material shaped and proportioned to extend between the wearer's shoulders and to extend downward therefrom, the improvement comprising:

said sheet of material having arm receiving openings proportioned and located to enable insertion of the wearer's arms through said sheet of material when said sheet of material is emplaced against the wearer's chest, said arm receiving openings being vertically extending slits which have a configuration that causes edge portions of said sheet of material to be directly behind the junctures of the wearer's arms and torso when an upper portion of said sheet of material is against the front of the wearer's neck at a location thereon that is above the base of the wearer's neck.

2. The bib of claim 1 wherein each of said slits extends continuously downward from an uppermost end of the slit to an opposite end of the slit, and wherein said sheet of material has a third vertically extending slit which intersects an upper edge of said upper portion of said sheet of material at a central location therealong.

3. The bib of claim 1 wherein said arm receiving opening slits have an arcuate configuration, upper and lower ends of said arm receiving opening slits being closer together than intermediate regions of said slits.

4. The bib of claim 1 wherein said sheet of material has upper and lower edges and opposite side edges which extend therebetween, further including a single pair of flexible tie strings each of which extends from a separate one of said opposite edges of said sheet of material and wherein said tie strings are connected to said opposite side edges of said sheet of material at locations which are spaced downward from said upper edge of said sheet of material.

5. The bib of claim 1 wherein at least a portion of said sheet of material is formed of transparent material.

6. The bib of claim 1 wherein said sheet of material is transparent and is bounded by upper and lower edges and opposite side edges, further including an edging of opaque fabric extending along at least a portion of said edges.

7. In a bib for covering the front of at least an upper region of a wearer's chest which bib has a sheet of flexible material shaped and proportioned to extend between the wearer's shoulders and to extend downward therefrom, the improvement comprising:

said sheet of material having arm receiving openings proportioned and located to enable insertion of the wearer's arms through said sheet of material when said sheet of material is emplaced against the wearer's chest wherein said sheet of material has upper and lower edges and opposite side edges which extend therebetween, further including a pair of flexible tie strings each of which extends from a separate one of said opposite edges of said sheet of material and wherein said tie strings are connected to said opposite side edges of said sheet of material at locations which are spaced downward from said upper edge of said sheet of material, wherein said arm openings are initially defined by perforated zones in said sheet of material and said tie strings are initially defined by additional perforated zones which extend upward from said lower edge of said sheet of material in spaced apart relationship with said side edges thereof.

8. The bib of claim 7 wherein another perforated zone in said sheet of material extends downward from said upper edge thereof at a location which is substantially centered between said opposite side edges thereof.

9. A bib comprising a sheet of flexible material bounded by upper and lower edges and opposite side edges which extend therebetween, said sheet of material having a first perforated zone that extends downward from said upper edge at a location which is substantially midway between said opposite side edges and having second and third perforated zones which extend vertically at locations below said upper edge each being in proximity to a separate one of said opposite side edges, said sheet of material further having fourth and fifth perforated zones which extend upward from said lower edge of said sheet of material in proximity to opposite edges thereof and which terminate at locations that are spaced downward from the upper edge of the sheet of material.

10. The bib of claim 9 wherein said sheet of material has an inner surface formed by a layer of waterproof material and an outer surface formed by a layer of absorbent material that is bonded to said layer of waterproof material.

* * * * *